United States Patent [19]

Kanno et al.

[11] Patent Number: 4,760,829

[45] Date of Patent: Aug. 2, 1988

[54] FUEL CONTROL APPARATUS FOR A FUEL INJECTION SYSTEM OF AN INTERNAL COMBUSTION ENGINE

[75] Inventors: Yoshiaki Kanno; Katsuya Nakamoto; Jiro Sumitani, all of Himeji, Japan

[73] Assignee: Mitsubishi Denki Kabushiki Kaisha, Japan

[21] Appl. No.: 46,640

[22] Filed: May 7, 1987

[30] Foreign Application Priority Data

May 9, 1986 [JP] Japan ..... 61-107204

[51] Int. Cl.[4] ..... F02M 51/00

[52] U.S. Cl. ..... 123/488; 123/494

[58] Field of Search ..... 123/478, 480, 486, 488, 123/494; 364/431.05

[56] References Cited

U.S. PATENT DOCUMENTS

| | | | |
|---|---|---|---|
| 4,269,157 | 5/1981 | Fujishiro | 123/478 |
| 4,455,985 | 6/1984 | Asayama | 123/494 |
| 4,550,705 | 11/1985 | Nagano et al. | 123/488 |
| 4,594,987 | 6/1986 | Wataya et al. | 123/494 |
| 4,606,318 | 8/1986 | Tsuchida et al. | 123/488 |
| 4,633,838 | 1/1987 | Fukui | 123/488 |
| 4,671,242 | 6/1987 | Akiyama et al. | 123/488 X |
| 4,683,539 | 7/1987 | Kanno et al. | 123/494 X |
| 4,694,806 | 9/1987 | Wataya et al. | 123/494 |
| 4,706,634 | 11/1987 | Nishikawa et al. | 123/492 |

FOREIGN PATENT DOCUMENTS

| | | |
|---|---|---|
| 2845014 | 5/1979 | Fed. Rep. of Germany . |
| 2429896 | 1/1980 | France . |
| 2562953 | 10/1985 | France . |
| 0193731 | 11/1982 | Japan . |
| 2103367 | 2/1983 | United Kingdom . |
| 2178196 | 2/1987 | United Kingdom . |

*Primary Examiner*—Willis R. Wolfe

*Attorney, Agent, or Firm*—Leydig, Voit & Mayer

[57] ABSTRACT

A fuel control apparatus for a fuel injection system of an internal combustion engine has an air flow sensor for sensing the air flow rate into the air intake pipe of the engine and producing an electrical output having a frequency which is proportional to the air flow rate, and a crank angle sensor for producing an electrical output pulse each time the crankshaft of the engine is at a prescribed crank angle. A load detector detects the number of output pulses from the air flow sensor between consecutive output pulses of the crank angle sensor, and an air flow rate calculator calculates the actual intake air flow rate into the cylinders of the engine based on the output of the load detector. A controller controls the supply of fuel to fuel injectors for the engine based on the output of the calculator. The load detector includes a frequency divider which performs frequency division of the output from the air flow sensor when the load exceeds a prescribed level.

2 Claims, 7 Drawing Sheets

FUEL CONTROL APPARATUS FOR A FUEL INJECTION SYSTEM OF AN INTERNAL COMBUSTION ENGINE

BACKGROUND OF THE INVENTION

This invention relates to a fuel control apparatus for a fuel injection system of an internal combustion engine which measures the rate of air intake into the engine using an air flow sensor and controls the supply of fuel to the engine based on the output of the sensor.

In an internal combustion engine which employs a fuel injection system, it is conventional to dispose an air flow sensor (hereinunder abbreviated as AFS) upstream of the throttle valve of the engine and to calculate the rate of air intake per each engine revolution based on the output of the AFS. The injection of fuel is then controlled based on the calculated intake air flow rate.

Since the AFS is disposed upstream of the throttle valve, the air flow rate measured by the AFS does not always coincide with the actual air flow rate into the engine cylinders. In particular, when the throttle valve is abruptly opened, there is a sudden increase in the air flow through the AFS, but due to the provision of a surge tank between the throttle valve and the engine cylinders, the increase in the air flow rate into the cylinders is more gradual and of a smaller magnitude than that into the AFS. Accordingly, the air flow measured by the AFS is greater than the actual air flow into the engine, and if the fuel supply were controlled based solely on the value measured by the AFS during a single brief period when the air flow rate was in transition, the fuel-air mixture would be overly rich. Therefore, the actual air flow rate into the engine cylinders is calculated as a weighted average of the value measured by the AFS over several periods, such as during two consecutive half-revolutions of the engine, and more accurate fuel control can be performed.

However, when the AFS is of the Karman vortex type, it produces output pulses whose frequency varies with the intake air flow rate, which depends upon the load of the engine. The frequency of the output typically varies from 40 to 1200 Hz. Furthermore, the frequency of the AFS output greatly fluctuates under a heavy load. At such a high frequency, a computer for processing the output signals from the AFS can not keep up with the output signals, the amount of intake air per engine revolution can not be accurately detected, and the fuel supply can not be correctly controlled.

SUMMARY OF THE INVENTION

It is therefore an object of the present invention to provide a fuel control apparatus for an internal combustion engine which can accurately control the supply of fuel to the engine over the entire operating range of the engine.

In a fuel control apparatus in accordance with the present invention, the intake air flow rate into the air intake pipe of an engine is measured by a Karman vortex air flow sensor, and the actual air intake flow rate into the cylinders of the engine is calculated by a controller based on the output of the air flow sensor and a crank angle sensor, which produces an electrical output at prescribed crank angles of the engine crankshaft. The supply of fuel to the engine is controlled based on the calculated intake air flow rate. When the load on the engine exceeds a certain level, a frequency divider performs frequency division of the output of the air flow sensor. The controller then performs calculations based on the frequency-divided output, and there is ample time for the controller to calculate the intake air flow rate. When the load on the engine is below this level, the frequency divider produces an output signal having the same frequency as the output signal of the air flow sensor, and the controller performs calculations based thereon. The magnitude of the engine load is determined based on the number of output pulses of the air flow sensor between consecutive pulses of the crank angle sensor.

A fuel control apparatus for a fuel injection system of an internal combustion engine in accordance with the present invention comprises air flow sensing means for sensing the air flow rate into the air intake pipe of the engine and producing an electrical output having a frequency which is proportional to the air flow rate, crank angle sensing means for producing an electrical output pulse each time the crankshaft of the engine is at a prescribed crank angle, frequency division means for frequency dividing the output signal of the air flow sensor when the engine load exceeds a prescribed value and for producing an output having the same frequency as the output of the air flow sensing means when the load is below the prescribed value, and control means for calculating the air flow rate into the cylinders of the engine based on the output of the frequency division means and the crank angle sensing means and for controlling the fuel injectors of the engine based on the calculated air flow rate.

BRIEF DESCRIPTION OF THE DRAWINGS

In the drawings, the same reference numerals indicate the same or corresponding parts.

DESCRIPTION OF THE PREFERRED EMBODIMENTS

Figure 1:
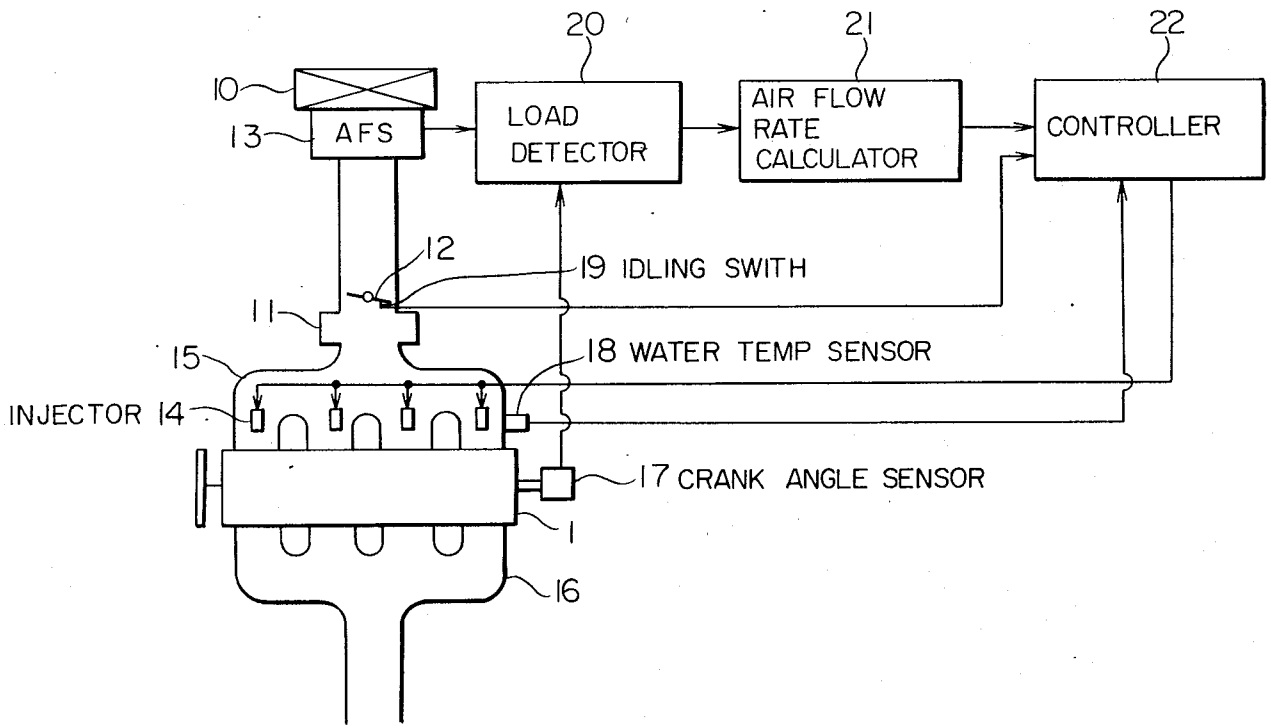
FIG. 1 is a block diagram of an embodiment of a fuel control apparatus in accordance with the present invention.

Hereinbelow, a preferred embodiment of a fuel control apparatus in accordance with the present invention will be described while referring to the accompanying drawings. FIG. 1 is a block diagram showing the overall structure of this embodiment as applied to a four-cylinder internal combustion engine 1. The engine 1 has an air intake pipe 15, at the upstream end of which is installed a Karman vortex AFS 13. The AFS 13 produces electrical pulses having a frequency corresponding to the intake air flow rate through the AFS 13. An air cleaner 10 is disposed upstream of the AFS 13. The air intake pipe 15 is equipped with a surge tank 11, a throttle valve 12, and four fuel injectors 14, each of which supplies fuel to one of the four cylinders of the engine 1. Combustion gas is exhausted from the engine 1 through an exhaust pipe 16. The engine 1 is further equipped with a crank angle sensor 17 which senses the angle of rotation of the crankshaft of the engine 1 and produces an electrical output pulse at prescribed crank angles, such as one pulse for every 180 degrees of crankshaft rotation. The water temperature of the engine cooling water is measured by a water temperature sensor 18, comprising a thermistor or the like, which produces an electrical output signal corresponding to the temperature, and the idling of the engine 1 is detected by an idling switch 19 which produces a corresponding electrical output signal.

A fuel control apparatus comprises the AFS 13, a load detector 20 for detecting the number of output pulses of the AFS 13 between consecutive pulses of the crank angle sensor 17, a calculating mechanism 21 for calculating the actual amount of intake air which enters the cylinders of the engine between consecutive pulses of the crank angle sensor 17 based on the output of the load detector 20, and a controller 22 which controls the fuel injectors 14 based on the output from the calculating mechanism 21, the water temperature sensor 18, and the idling switch 19.

Figure 2:
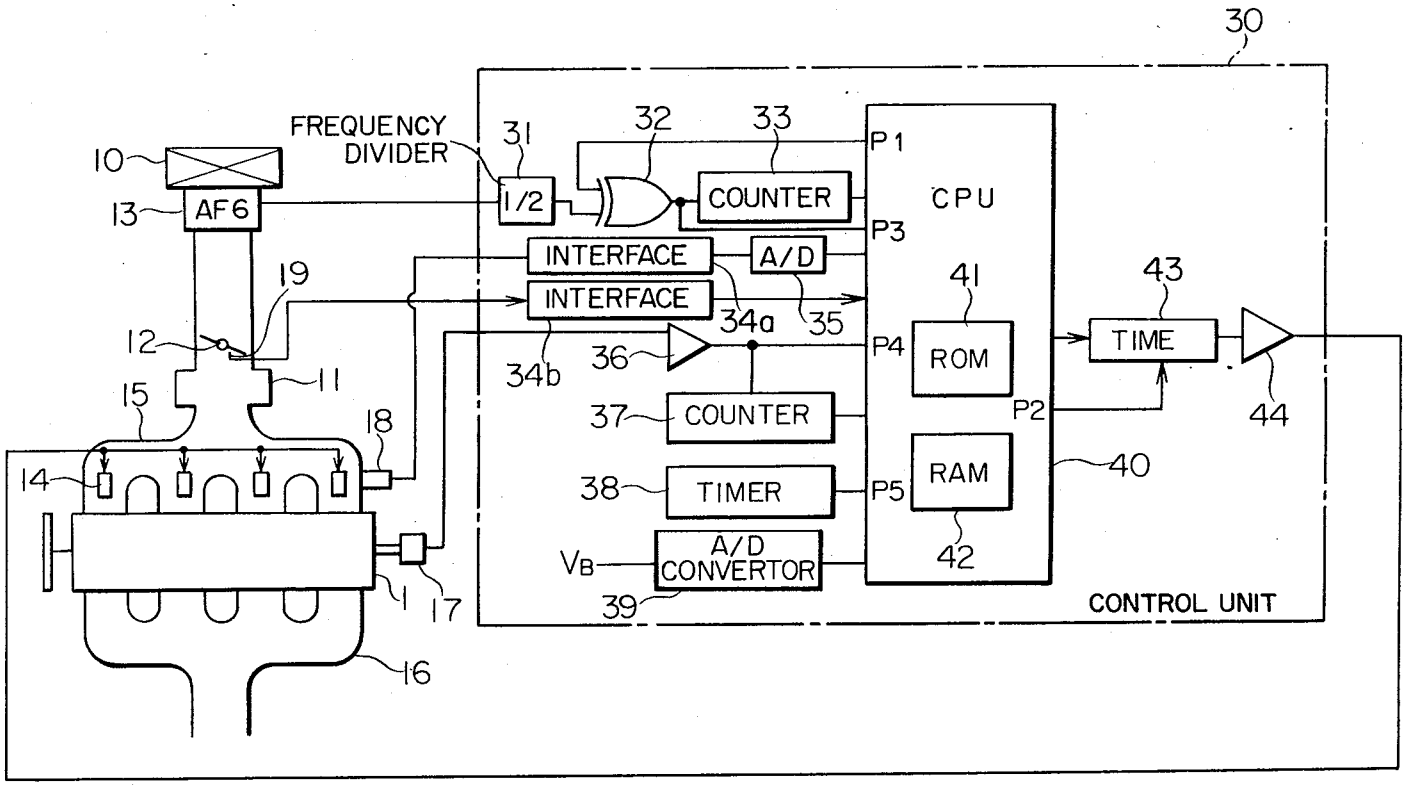
FIG. 2 is a block diagram showing the construction of the embodiment of FIG. 1 in greater detail.

FIG. 2 shows the structure of this embodiment more concretely. The load detector 20, the calculating mechanism 21, and the controller 22 together constitute a control unit 30 which controls the four injectors 14 and into which the output signals of the AFS 13, the crank angle sensor 17, the water temperature sensor 18, and the idling switch 19 are input. The control unit 30 is controlled by a CPU 40 having a ROM 41 and a RAM 42. The output signal of the AFS 13 is input to a frequency divider 31 which produces an output signal having one-half the frequency of the AFS output signal. The output signal of the frequency divider 31 is input to one of the input terminals of an exclusive OR gate 32. The other input terminal is connected to an output port P1 of the CPU, whose output corresponds to the status of a frequency division flag in the RAM 42. The output terminal of the exclusive OR gate 32 is connected to a counter 33 and an interrupt input port P3 of the CPU 40. The output signal of the temperature sensor 18, which is an analog value, is input to an A/D converter 35 through an interface 34*a*, and the digitalized value is input to the CPU 40. The output signal from the idling switch 19 is input to the CPU 40 through another interface 34*b*. The output signal from the crank angle sensor 17 is input to a waveform shaper 36, and the shaped waveform is input to an interrupt input port P4 of the CPU 40 and to a counter 37. A timer 38 is connected to an interrupt input port P5 of the CPU 40. An unillustrated battery for the engine is connected to an A/D converter 39, which produces a digital output signal corresponding to the voltage $V_B$ of the battery and outputs the signal to the CPU 40. A timer 43 is connected between an output port P2 of the CPU 40 and a driver 44 which is connected to each of the four fuel injectors 14.

Figure 3:
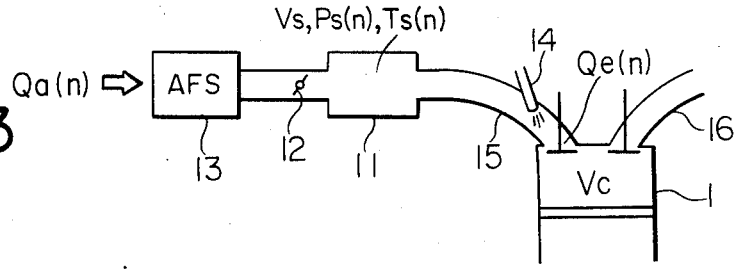
FIG. 3 is a block diagram of a model of the air intake system of an internal combustion engine employing the present invention.

Before describing the operation of this embodiment in detail, the principles underlying the calculations which are performed by the CPU 40 will be explained while referring to FIGS. 3 through 5. FIG. 3 illustrates a model of the air intake system of the internal combustion engine 1 of FIG. 1. The displacement of the engine 1 is $V_C$, while the volume from the throttle valve 12 to the intake valves of the engine 1 is $V_s$.

Figure 4:
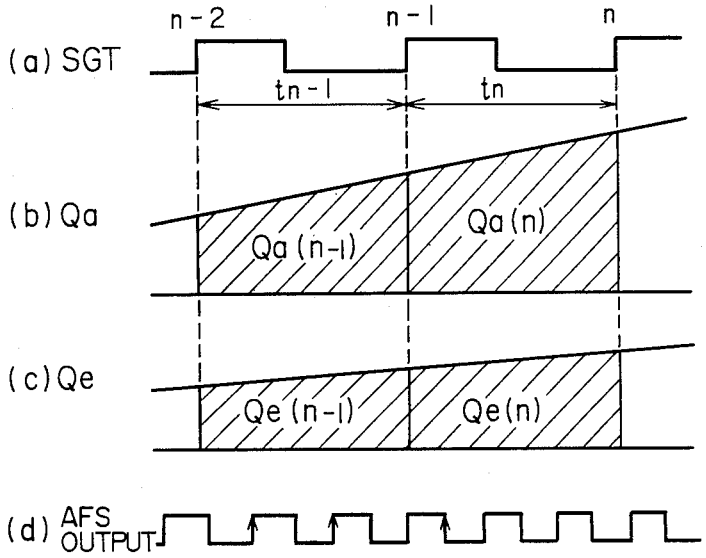
FIG. 4 is a diagram of the relationship between the air intake into the AFS of FIG. 3 and the air intake into the cylinders of the engine.

FIG. 4 illustrates the relationship between the air flow rate $Q_a$ into the AFS 13 and the air flow rate $Q_e$ into the cylinders of the engine 1. In FIG. 4, (a) illustrates the output (abbreviated as SGT) of the crank angle sensor 17 which outputs a pulse every 180 degrees of crankshaft rotation, while (d) illustrates the output of the AFS 13.

The length of time between the (n−2)th rise and the (n−1)th rise of SGT is $t_{n-1}$, and the time between the (n−1)th rise and the nth rise is $t_n$. The amounts of intake air which pass through the AFS 13 during periods $t_{n-1}$ and $t_n$ are $Q_{a(n-1)}$ and $Q_{a(n)}$, respectively, and the amounts of air which enter the cylinders of the engine 1 during the same periods $t_{n-1}$ and $t_n$ are $Q_{e(n-1)}$ and $Q_{e(n)}$, respectively. Furthermore, the average pressure and the average intake air temperature in the surge tank 11 during periods $t_{n-1}$ and $t_n$ are respectively $P_{s(n-1)}$ and $P_{s(n)}$ and $T_{s(n-1)}$ and $T_{s(n)}$. $Q_{a(n-1)}$ corresponds to the number of output pulses from the AFS 13 in the time period $t_{n-1}$. As the rate of change of the intake air temperature is small, $T_{s(n-1)}$ is approximately equal to $T_{s(n)}$, and if the charging efficiency of the internal combustion engine 1 is constant, then the following relationships hold:

$$P_{s(n-1)} \times V_c = Q_{e(n-1)} \times R \times T_{s(n)} \quad (1)$$

$$P_{s(n)} \times V_c = Q_{e(n)} \times R \times T_{s(n)} \quad (2)$$

wherein R is a constant. If the amount of air which remains in the surge tank 11 and the air intake pipe 15 during period $t_n$ is $\Delta Q_{a(n)}$, then $$\Delta Q_{a(n)} = Q_{a(n)} - Q_{e(n)} = V_s \times (1/RT_s) \times (P_{s(n)} - P_{s(n-1)}) \quad (3)$$

and from Equations (1)–(3), the following equation is obtained:

$$Q_{e(n)} = [1/(1+V_c/V_s)] \times Q_{e(n-1)} + [1-1/(1+V_c/V_s)] \times Q_{a(n)} \quad (4)$$

Accordingly, the amount of air $Q_{e(n)}$ which enters the internal combustion engine 1 in period $t_n$ can be calculated based on the amount of air $Q_{a(n)}$ which passes through the AFS 13. For example, if $V_c = 0.5$ liters and $V_s = 2.5$ liters, then $$Q_{e(n)} = 0.83 \times Q_{e(n-1)} + 0.17 \times Q_{a(n)} \quad (5)$$

Figure 5:
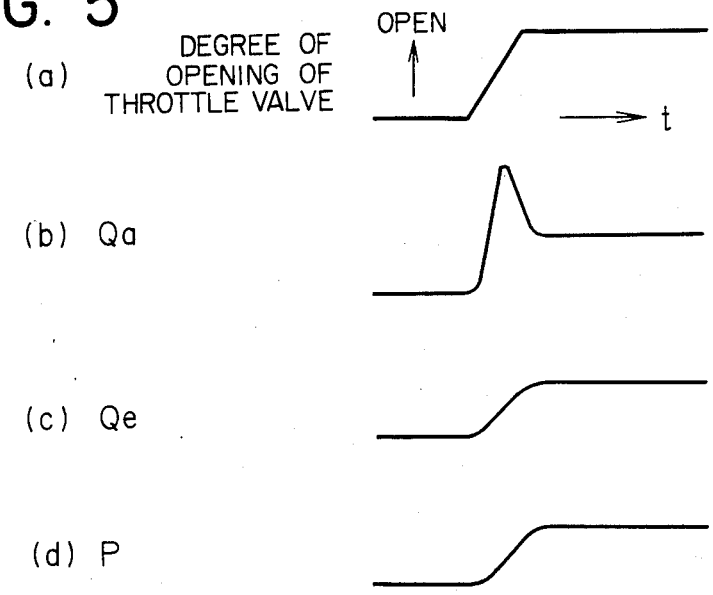
FIG. 5 is a waveform diagram showing the changes in the rate of air intake into the air intake system of FIG. 3 when the throttle valve is suddenly opened.

FIG. 5 illustrates the state within the air intake passageway 15 when the throttle valve 12 is suddenly opened. In FIG. 5, (a) shows the degree of opening of the throttle valve 12, and (b) shows the air flow rate $Q_a$ through the AFS 13. As can be seen from (b), the air flow rate $Q_a$ abruptly increases and overshoots a steady-state value, after which it decreases to the steady-state value. (c) shows how the air flow rate $Q_e$ into the cylinders of the engine increases gradually to the same steady-state value without overshooting, and (d) shows the variation in the pressure P within the surge tank 11.

Next, the operation of the embodiment illustrated in FIG. 2 will be explained. The output of the AFS 13 is frequency divided by the frequency divider 31, and the output thereof, which has a frequency which is half of that of the AFS output, is input to counter 33 through the exclusive OR gate 32, which is controlled by the CPU 40. Counter 33 measures the period between the falling edges of the output of the exclusive OR gate 32. Each time there is a fall in the output of the exclusive OR gate 32, which is input to interrupt input port P3, the CPU 40 performs interrupt handling and the period of counter 33 is measured. The interrupt handling is performed once every one or two periods of the output of the AFS 13, depending on the status of output port P1 of the CPU 40, which depends on the status of the frequency division flag within the RAM 42. The output of the water temperature sensor 18 is converted into a voltage by interface 34*a*, the output of interface 34*a* is changed into a digital value by A/D converter 35 at prescribed intervals, and the output of A/D converter 35 is input to the CPU 40. The output of the crank angle sensor 17 is input to interrupt input port P4 of the CPU 40 and to counter 37 through the waveform shaper 36. The output of the idling switch 19 is input to the CPU 40 through interface 34*b*. The CPU 40 performs interrupt handling on each rising edge of the output of the crank angle sensor 17, and the period between the rising edges of the output of the crank angle sensor 17 is determined based on the output of counter 37. At prescribed intervals, timer 38 generates an interrupt request which is applied to interrupt input port P5 of the CPU 40. A/D converter 39 performs A/D conversion of the voltage $V_B$ of the unillustrated battery, and at prescribed intervals, the CPU 40 reads in this battery voltage data. Timer 43 is preset by the CPU 40 and is triggered by output port P2 of the CPU 40. The timer 43 outputs pulses of a prescribed width, and this output drives the injectors 14 through the driver 44.

Figure 6:
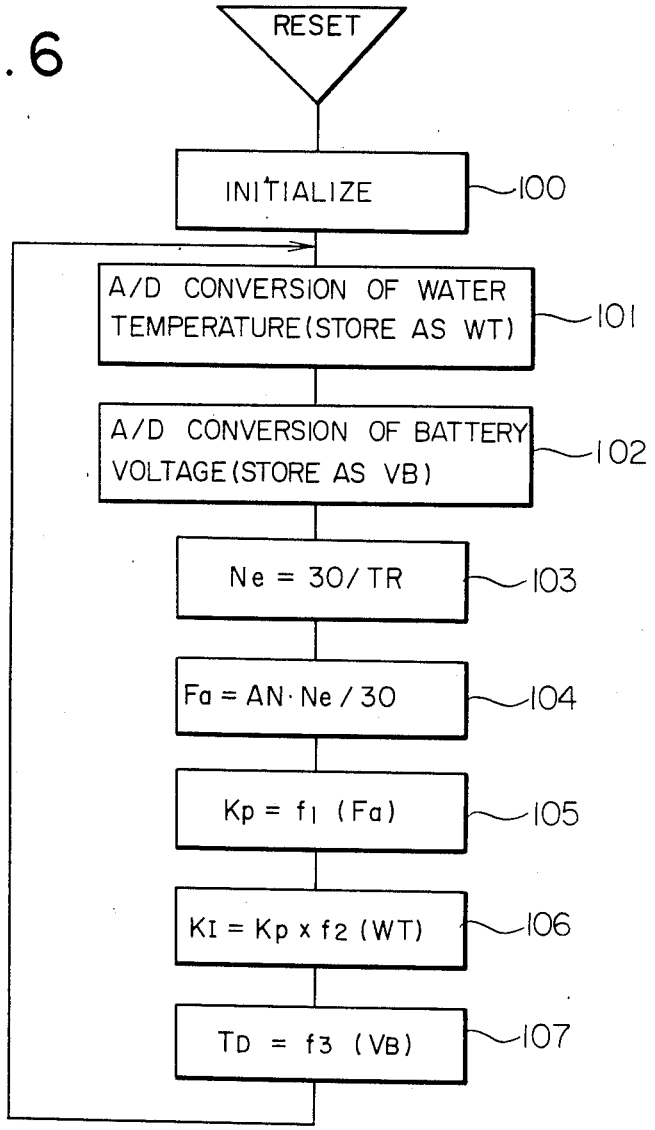
FIG. 6 is a flow chart of the main program executed by the CPU 40 of FIG. 2.
Figure 7:
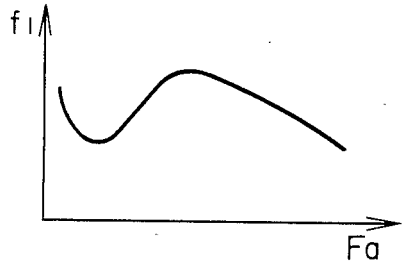
FIG. 7 is a diagram showing the relationship between the output frequency $F_a$ of the AFS of the embodiment of FIG. 2 and a fundamental ignition timing conversion coefficient $f_1$.

Next, the operation of the CPU 40 will be explained while referring to the flow charts of FIGS. 6, 8, and 9. FIG. 6 illustrates the main program of the CPU 40. When a reset signal is input to the CPU 40, the RAM 42, the input ports, and the like are initialized in Step 100. In Step 101, A/D conversion of the output of the water sensor 18 is performed and the result is stored in the RAM 42 as WT. In Step 102, A/D conversion of the battery voltage is performed and the result is stored in the RAM 42 as VB. In Step 103, the rotational speed $N_e$ in RPM of the engine is determined by calculating the value of $30/T_R$, wherein $T_R$ is the period in seconds of the output signal from the crank angle sensor 17 and equals the time for the crankshaft to turn 180 degrees. In Step 104, the frequency $F_a$ of the output signal of the AFS 13 is calculated by the equation $AN \times N_e/30$. AN is referred to as load data; it is equal to the number of output pulses which are generated by the AFS 13 between the rising edges of two consecutive pulses of the crank angle sensor 17 and is indicative of the engine load. In Step 105, based on the output frequency $F_a$, a fundamental ignition timing conversion coefficient $K_p$ is calculated using a function $f_1$ which has a value with respect to $F_a$ as shown in FIG. 7. In Step 106, the fundamental ignition timing conversion coefficient $K_p$ is corrected by a function $f_2$, which depends on the value of the water temperature data WT, and the corrected value is stored in the RAM 42 as ignition timing conversion coefficient $K_I$. In Step 107, based on the battery voltage data VB, a data table $f_3$ which is previously stored in the ROM 41 is read, and the dead time $T_D$ (the time lag in the response of the fuel injectors 14) is calculated and stored in the RAM 42. After Step 107, the program recycles by returning to Step 101.

Figure 8:
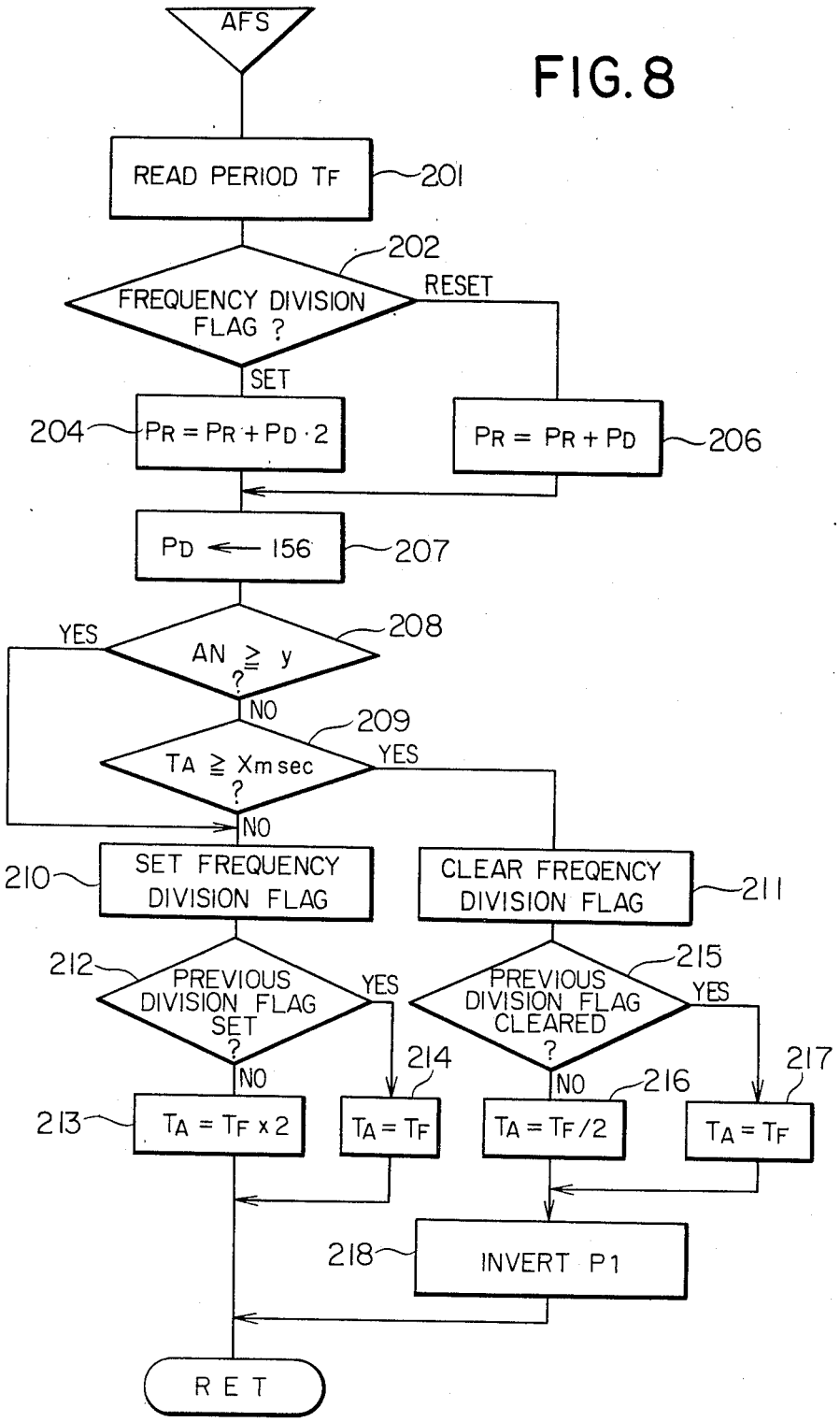
FIG. 8 and FIG. 9 are flow charts of interrupt handling routines performed by the CPU 40 of FIG. 2.

FIG. 8 illustrates an interrupt handling routine which is performed by the CPU 40 each time the output of the exclusive OR gate 32 falls. In Step 201, the output $T_F$ of the counter 33 is read, and then the counter 33 is cleared. $T_F$ is the period between consecutive rises in the output of the exclusive OR gate 32. In Step 202, if the frequency division flag of the RAM 42 is set, then in Step 204, two times a value which is referred to as the remaining pulse data $P_D1$ is added to the cumulative pulse data $P_R$ to obtain a new value for the cumulative pulse data $P_R$. The cumulative pulse data $P_R$ is the total number of pulses which are output by the AFS 13 between the rises in consecutive pulses in the output of the crank angle sensor 17. In order to ensure the accuracy in calculation of the CPU 40, $P_R$ is incremented by 156 for each pulse from the AFS 13, so that the value of $P_R$ equals 156 times the actual number of output pulses of the AFS 13. In Step 202, if the frequency division flag is reset, then in Step 206, the remaining pulse data $P_D$ is added to the cumulative pulse data $P_R$. In Step 207, the remaining pulse data $P_D$ is set equal to 156. In Step 208, it is determined whether or not the load data AN is greater than a prescribed value Y. If it is greater, the program proceeds to Step 210, and if it is smaller, the program proceeds to Step 209. In Step 209, the period $T_A$ is compared with a prescribed value X, which is 2 msec. when the frequency division flag is reset and is 4 msec. when the frequency division flag is set. If $T_A \geqq X$ msec., then the program proceeds to Step 211. Otherwise it proceeds to Step 210, in which the frequency division flag is set. After Step 210, it is determined, in Step 210, whether the previous frequency division flag is set, and if the previous frequency division flag is cleared, in Step 213 the period $T_F$ of the output pulse of the AFS 13 multiplied by 2 is stored in the RAM 42 as $T_A$. On the other hand, if it is determined that the previous frequency division flag is set, then in Step 214, the period $T_F$ is simply stored in the RAM 42 as $T_A$. After the processing of Step 213 or 214, interrupt handling is completed.

On the other hand, in Step 209, if it is determined that $T_A \geqq X$ msec., the frequency division flag is cleared in Step 211, and then in Step 215, it is determined whether or not the previous frequency division flag is cleared. If not, in Step 216 the above-mentioned period $T_F$ divided by 2 is stored in the RAM 42 as $T_A$, but if so, in Step 217 the period $T_F$ is simply stored in the RAM 42 as $T_A$. Thereafter, in Step 218, the level of the output port P1 is inverted and interrupt handling is completed. Thus, in short, if Step 210 is performed, an interrupt request is input to the interrupt input port P3 on every other output pulse of the AFS 13. In contrast, if Step 211 is performed, an interrupt request is input to the interrupt input port P3 upon each output pulse of the AFS 13.

Figure 9:
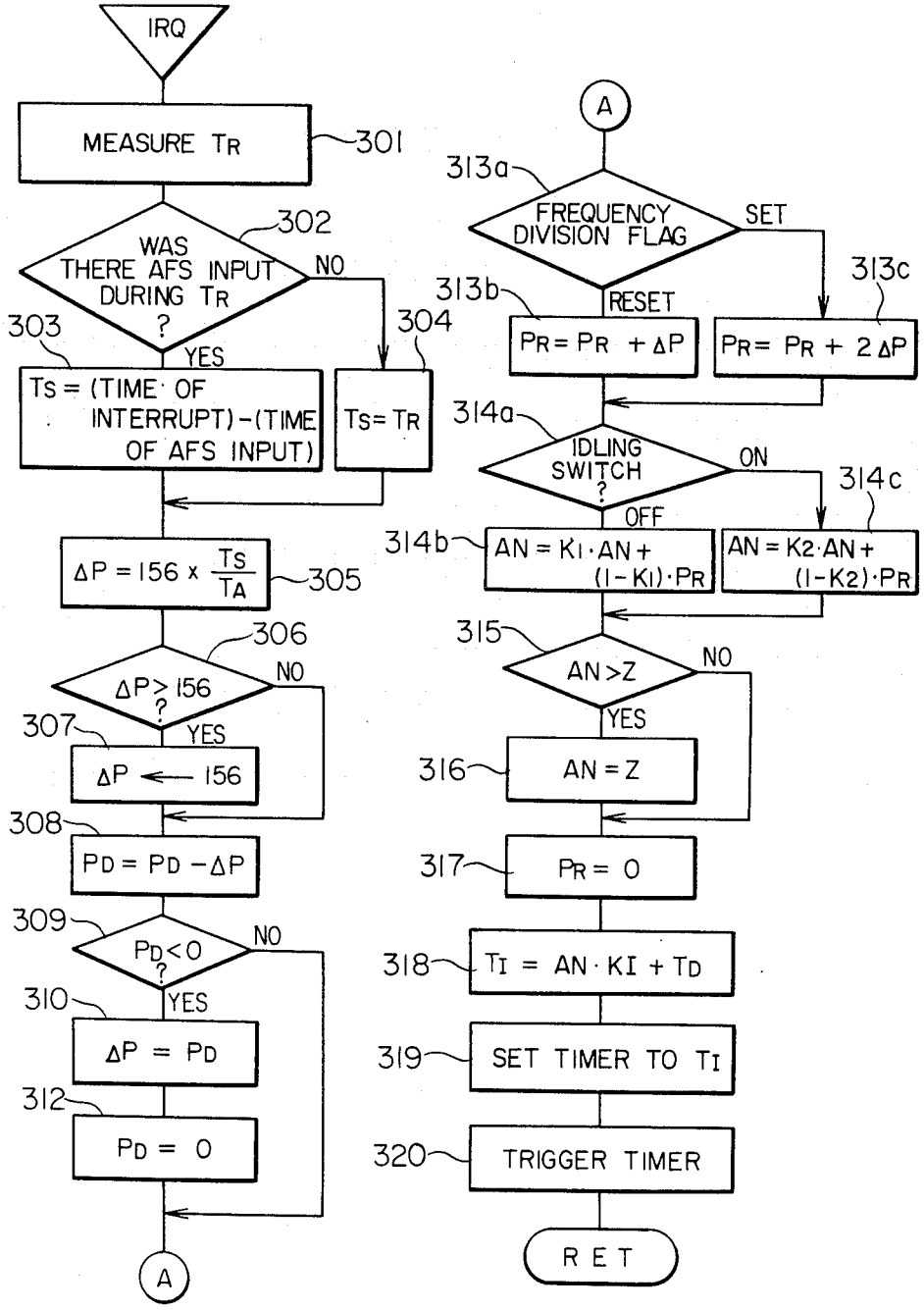
Figure 10:
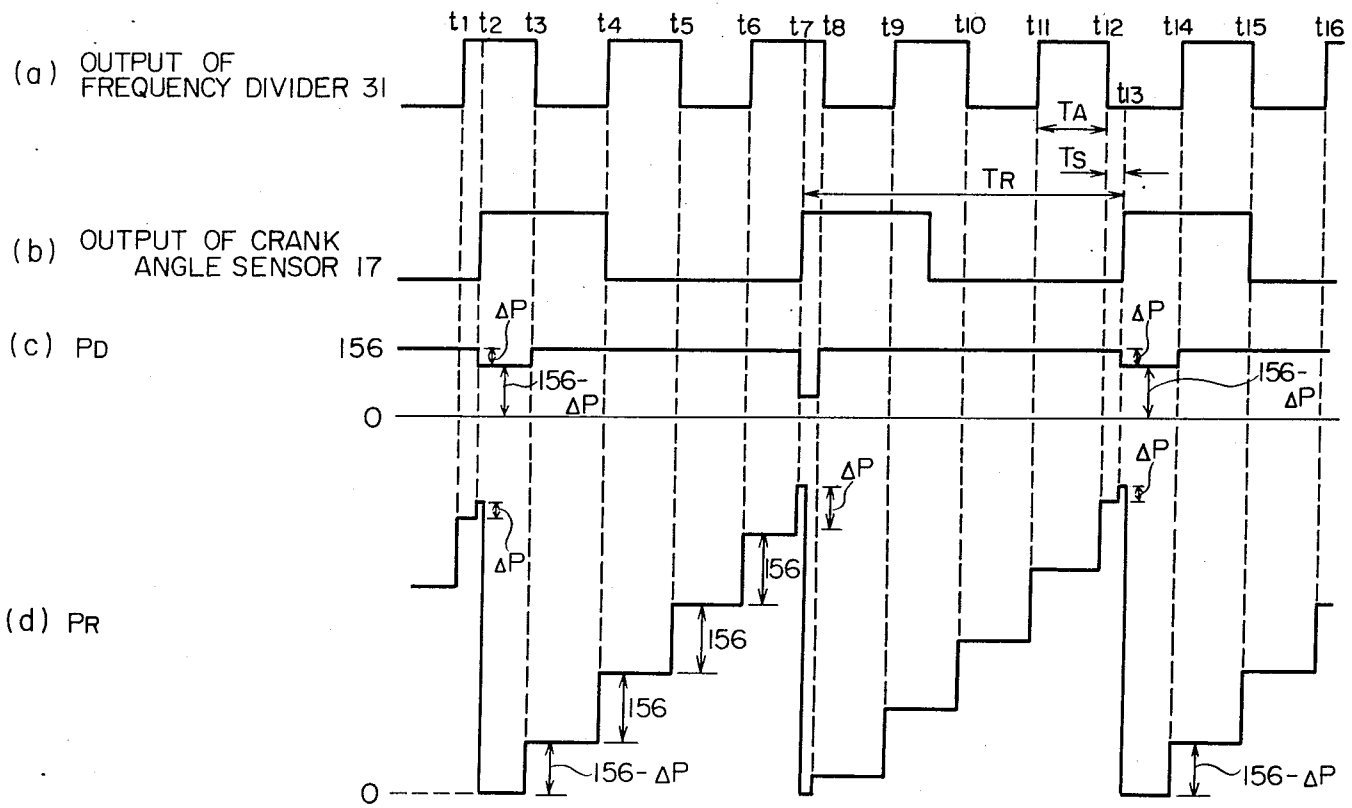
FIG. 10 is a timing diagram showing the values of various parameters during the operation of the embodiment of FIG. 2.

FIG. 9 illustrates an interrupt handling routine which is performed by the CPU 40 each time an interrupt request is input to the interrupt input port P4, which takes place upon each rise in the output of the crank angle sensor 17. This flow chart will be explained for the case that an interrupt request is input at time $t_{13}$ in FIG. 10, which is a timing diagram illustrating (a) the output of the frequency divider 31, (b) the output of the crank angle sensor 17, (c) the calculated value of $P_D$, and (d) the calculated value of $P_R$ during the processing shown in FIG. 9 when the frequency division flag is cleared. In Step 301, the period between the present rise (at time $t_{13}$) and the previous rise (at time $t_7$) in the output of the crank angle sensor 17 is read from the counter 37 and is stored in the RAM 42 as period $T_R$. The counter 37 is then cleared. In Step 302, it is determined whether there was an output pulse from the gate 32 during the period $T_R$. If so, then in Step 303, the time difference $T_S$ between the time of the immediately preceding output pulse of the gate 32 (at time $t_{12}$) and the time of the present interrupt request (at time $t_{13}$) is calculated. In the case of FIG. 10, $T_S=t_{13}-t_{12}$. When there was no output pulse from the gate 32 during period $T_R$, then period $T_S$ is set equal to period $T_R$. In Step 305, the time difference $T_S$ is converted into output pulse data $\Delta P$. The pulse data $\Delta P$ is the amount by which the cumulative pulse data $P_R$ should be increased for the length of time $T_S$. In this case, $\Delta P$ is set equal to $156\times T_S/T_A$. In this connection, as can be seen from FIG. 10, the exact value of $\Delta P$ is $156\times T_S/(t_{14}-t_{12})$. However, as $t_{14}$ has yet to take place, it is assumed that $(t_{14}-t_{12})$ is equal to $T_A$, or in other words, it is assumed that the output of the gate 32 will remain substantially constant over two cycles. In Step 306, if the value of pulse data $\Delta P$ is less than or equal to 156, then the program proceeds to Step 308, and if it is larger, then in Step 307 $\Delta P$ is reduced to 156. In Step 308, the remaining pulse data $P_D$ is decreased by the pulse data $\Delta P$, and the decreased value is made the new remaining pulse data $P_D$. In Step 309, if the remaining pulse data $P_D$ is positive or zero, then the program proceeds to Step 313*a*, and otherwise, the calculated value of the pulse data $\Delta P$ is too much greater than the output pulse of the AFS 13, so in Step 310, the pulse data $\Delta P$ is set equal to $P_D$, and in Step 312, the remaining pulse data $P_D$ is set equal to zero. In Step 313*a*, it is determined whether the frequency division flag is set. When it is reset, then in Step 313*b* the cumulative pulse data $P_R$ is increased by the pulse data $\Delta P$, and when it is set, then in Step 313*c* $P_R$ is increased by $2\times\Delta P$, and a new value for the cumulative pulse data $P_R$ is obtained. $P_R$ is proportional to the number of pulses which it is thought that the AFS 13 output between consecutive rises in the output of the crank angle sensor 17, i.e., between times $t_7$ and $t_{13}$. In Steps 314*a–c*, a calculation corresponding to Equation (5) is performed and a new value of the load data AN is calculated based on the old value of the load data AN which was calculated up to the previous rise in the output of the crank angle sensor 17 (at time $t_7$) and the cumulative pulse data $P_R$ which was just calculated. In Step 314*a*, it is first determined whether the idling switch 19 is on, indicating an idling state. If it is on, then in Step 314*c*, the calculation $AN=(K_2)AN+(1-K_2)P_R$ is performed, and if idling switch 23 is off, then in Step 315*c*, the calculation $(K_1)AN+(1-K_1)P_R$ is performed, wherein $K_1$ and $K_2$ are constants ($K_1>K_2$). In Step 315, if the new load data AN is larger than a prescribed value Z, then in Step 316 it is reduced to Z so that even when the throttle of the engine 1 is fully open the load data AN will not overly exceed the actual value. In Step 317, the cumulative pulse data $P_R$ is set equal to zero. In Step 318, ignition timing data $T_I$ is calculated based on the load data AN, the ignition timing conversion coefficient $K_I$, and the dead time $T_D$ in the manner $T_I=AN\times K_I=T_D$. In Step 319, the ignition timing data $T_I$ is set in the timer 43, and by triggering the timer 43 in Step 320, the four injectors 14 are simultaneously driven in accordance with the value of $T_I$, and interrupt handling is completed.

In the manner described above, in accordance with the present invention, when the load on the engine (as indicated by the value of the load data AN) is below a certain level, a signal having the same frequency as the output of the AFS 13 is input to the CPU 40, and when the load (and the value of AN) exceeds this level, the output of the AFS 13 is frequency divided before being input to the CPU 40. Therefore, ample time for the CPU 40 to calculate the rate of air intake into the engine is guaranteed, and the fuel supply can be accurately controlled over the entire operating range of the engine.

In the above-described embodiment, the output pulses of the AFS 13 are counted between the rises in the output of the crank angle sensor 17, but counting may be performed between falls. Furthermore, the number of output pulses of the AFS 13 can be counted over several periods of the output of the crank angle sensor 17 instead of over a single period. Also, although the actual number of output pulses of the AFS 13 were counted, a value which is the number of output pulses of the AFS 13 multiplied by a constant corresponding to the output frequency of the AFS 13 may be counted. In addition, the angle of the crankshaft need not be detected by a crank angle sensor 17, and the same effects can be obtained using the ignition signal for the engine.

What is claimed is:

1. A fuel control apparatus for a fuel injection system of an internal combustion engine having at least one fuel injector for supplying fuel to corresponding cylinders of said engine, said fuel control apparatus comprising:

air flow sensing means for sensing a rate of air flowing into an air intake pipe of the engine and producing an electrical output signal having a frequency proportional to said air flow rate;

crank angle sensing means for producing an electrical output pulse each time a crankshaft of the engine is at a prescribed crank angle;

frequency division means for producing an output having a frequency which is one-half the output signal frequency of said air flow sensing means by performing frequency division of the output signal of said air flow sensing means when engine load exceeds a prescribed value and for producing an output having the same frequency as the output signal of said air flow sensing means when engine load is below said prescribed value; and control means for determining an actual rate of air flowing into the cylinders of said engine based on the output of said frequency division means and the output pulse of said crank angle sensing means and for controlling the fuel injector based on said previously determined air flow rate.

2. A fuel control apparatus as claimed in claim 1 wherein said output signal is in the form of pulses and said control means includes means for controlling said frequency division means so as to perform frequency division of the output signal of said air flow sensing means when the number of output pulses of said air flow sensing means between consecutive output pulses of said crank angle sensing means exceeds a prescribed value or when the period of the output pulses of said air flow sensing means is below a prescribed value.

* * * * *